US007267585B2

(12) United States Patent
Wilk

(10) Patent No.: US 7,267,585 B2
(45) Date of Patent: Sep. 11, 2007

(54) METHOD AND SYSTEM FOR EASING ATTACHMENT OF A PERIPHERAL CABLE TO A PERSONAL COMPUTER

(75) Inventor: Tomasz Franciszek Wilk, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/090,414

(22) Filed: Mar. 24, 2005

(65) Prior Publication Data

US 2006/0217002 A1 Sep. 28, 2006

(51) Int. Cl.
*H01R 13/64* (2006.01)

(52) U.S. Cl. ..... 439/680; 439/490

(58) Field of Classification Search ..... 439/490, 439/502, 680

See application file for complete search history.

(56) References Cited

U.S. PATENT DOCUMENTS

| | | | | |
|---|---|---|---|---|
| 3,614,711 | A | 10/1971 | Cicero et al. | |
| 4,179,179 | A | 12/1979 | Lowden | |
| 5,392,194 | A | 2/1995 | Zell et al. | |
| 5,404,268 | A * | 4/1995 | O'Connor | 361/683 |
| 5,766,040 | A | 6/1998 | Naerland et al. | |
| 6,145,037 | A * | 11/2000 | Sakakibara | 710/301 |
| 6,364,710 | B1 | 4/2002 | Billman et al. | |

* cited by examiner

*Primary Examiner*—Khiem Nguyen
(74) *Attorney, Agent, or Firm*—Sawyer Law Group LLP

(57) ABSTRACT

Aspects for easing the attachment of a peripheral cable to a personal computer (PC) include providing a connector with a symmetric shape that supports multiple orientations of cable attachment to a PC. An orientation of insertion is identified when the connector is attached to the PC, and signal lines from the connector are rearranged based on the identified orientation of the connector.

9 Claims, 1 Drawing Sheet

METHOD AND SYSTEM FOR EASING ATTACHMENT OF A PERIPHERAL CABLE TO A PERSONAL COMPUTER

FIELD OF THE INVENTION

The present invention relates to peripheral cable connectors for personal computers, and more particularly to symmetric cable connectors for easing attachment of peripheral cables to personal computers.

BACKGROUND OF THE INVENTION

Personal computer (PC) systems typically connect to external devices, such as printers, joysticks, scanners, routers, etc., using cables. Examples include USB (Universal Serial Bus), PS/2, serial, and parallel cables. These peripheral cables can only be inserted into a socket one particular way, thus requiring a user to visually check the cable orientation before inserting. If the cable plugs in to the back of a laptop or stand-alone PC, the user is required to either physically move the machine and look at the socket orientation, or the user has to walk to the back of the system, which is a nuisance.

Accordingly, a need exists for a manner of easing the attachment of peripheral cables to a PC. The present invention addresses such a need.

BRIEF SUMMARY OF THE INVENTION

Aspects for easing the attachment of a peripheral cable to a personal computer (PC) include providing a connector with a symmetric shape that supports multiple orientations of cable attachment to a PC. An orientation of insertion is identified when the connector is attached to the PC, and signal lines from the connector are rearranged based on the identified orientation of the connector.

A symmetric connector supports multiple insertion orientations of a peripheral cable to a PC. Such multiple insertion orientations and auto-discovery of a chosen insertion orientation allows a user to more easily insert a connector without having to do a visual check for a socket before inserting. These and other advantages of the aspects of the present invention will be more fully understood in conjunction with the following detailed description and accompanying drawings.

DETAILED DESCRIPTION OF THE INVENTION

The present invention relates to a manner of easing the attachment of a peripheral cable to a PC. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiments shown but is to be accorded the widest scope consistent with the principles and features described herein.

Figure 1:
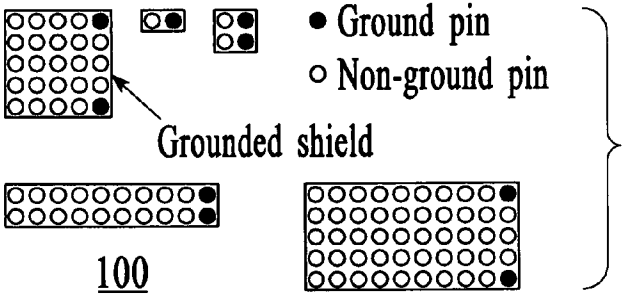
FIG. 1 illustrates examples of symmetric connectors in accordance with the present invention.

FIG. 1 illustrates examples 100 of symmetric connectors in accordance with the present invention. The symmetric shape of the connectors 100 allows more than one insertion orientation, i.e., rectangular connectors can be inserted in either of two different ways, while square connectors can be inserted in any one of four ways, which eases the ability to attach the connector without needing to visually check the cable orientation before inserting. Since more than one insertion orientation is supported, the present invention further includes techniques for auto-discovery of the insertion orientation used. In order to support auto-discovery of the insertion orientation, two of the four corner pins along an edge of the connector need to be designated as ground pins, where ground pins are shown as solid black circles in FIG. 1. The auto-discovery technique utilizes a leakage test to determine the insertion orientation based on the ground pin designation, as described with reference to FIG. 2.

Figure 2:
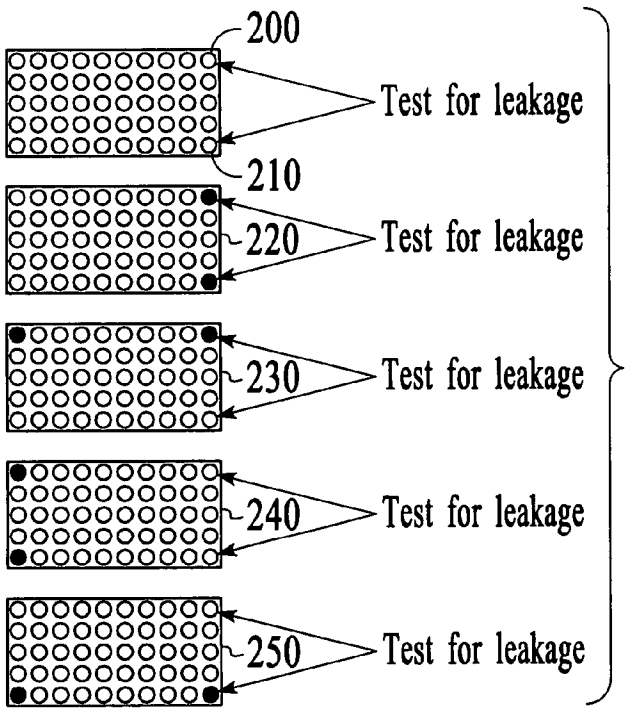
FIG. 2 illustrates four possible ground pin combinations for a symmetric connector that can be detected via a leakage test in accordance with the present invention.

FIG. 2 illustrates four possible ground pin combinations for a symmetric connector that can be detected via a leakage test in accordance with the present invention. Top 200 and bottom 210 corner pins of a right-hand edge of the connector are used to identify the ground pin combination used by a particular connector. When the leakage test can source/sink current at a tested pin, the tested pin is determined to be a ground pin. Conversely, when the leakage test cannot source/sink current at a tested pin, the tested pin is determined to not be a ground pin, as is well understood in the art. Thus, when a connector is inserted, the leakage test is run, such as by the system which receives the connector, to determine whether the corner pins being tested correspond to ground pins. As shown by FIG. 2, connector 220 is determined to have ground pins at both the top and bottom tested corner pins. Connector 230 is determined to have one ground pin at the top tested corner pin. Connector 250 is determined to have one ground pin at the bottom tested corner pin. Connector 240 is determined to have no ground pin at either tested corner pin.

Figure 3:
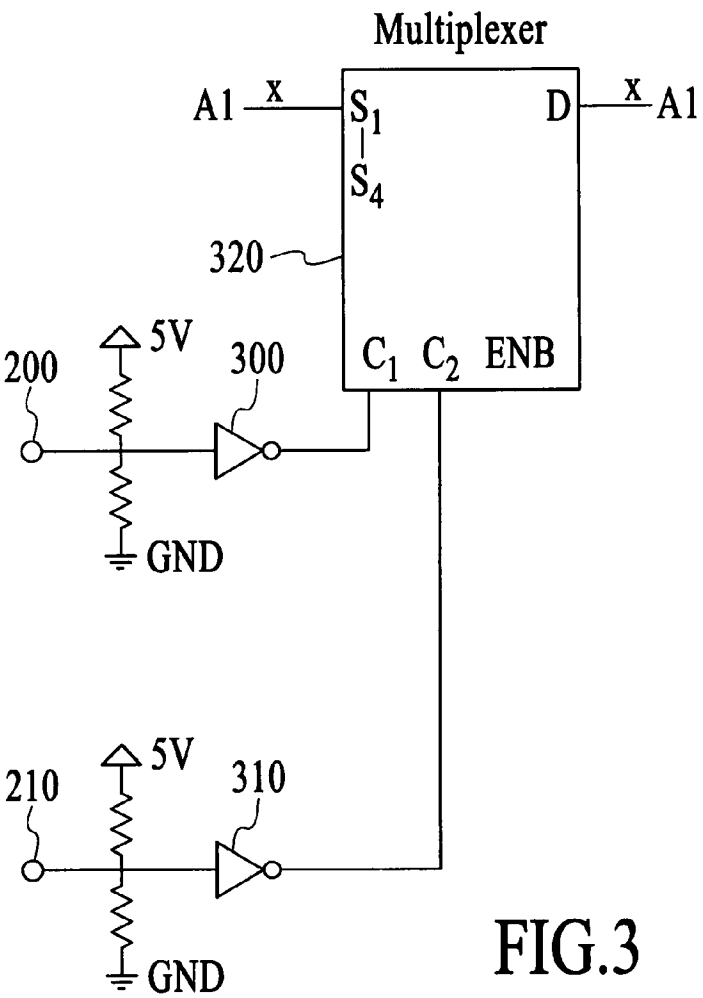
FIG. 3 illustrates an example of a circuit for rearranging signal lines of a connector in accordance with the present invention.

Based on the orientation detected with the leakage test, the individual signal lines can be rearranged using muxes or relays. For example, FIG. 3 shows a circuit that may be used to accomplish such rearranging. As shown, the leakage test pins 200, 210 are coupled via biased signal lines to inverters 300, 310. The output of each inverter 300, 310 provides a signal for input to control pins C1, C2 of a multiplexer 320. The multiplexer 320 muxes the signals on its input pins for output on the data pins according to the control pin C1, C2 signal levels, as is well understood in the art. In order to simplify complexity, connectors with a large number of signal lines should use non-square rectangular connectors.

Although the present invention has been described in accordance with the embodiments shown, one of ordinary skill in the art will readily recognize that there could be variations to the embodiments and those variations would be within the spirit and scope of the present invention. For example, the cable connector itself can be equipped with a small circuit that auto-discovers the plug orientation and shifts/muxes signals, accordingly. Further, the symmetric shape has been described with reference to a preferred embodiment of a rectangular shape. Other symmetric shapes could be used but may require more complex orientation detection and signal shifting. Accordingly, many modifications may be made by one of ordinary skill in the art without departing from the spirit and scope of the appended claims.

I claim:

1. A method for easing the attachment of a peripheral cable to a personal computer, the method comprising:

providing a connector with a symmetric shape that supports at least four orientations of cable attachment to a personal computer;

identifying an orientation of insertion when the connector is attached to the personal computer; and rearranging signal lines from the connector based on the identified orientation of the connector.

2. The method of claim 1 wherein the symmetric shape comprises a square shape.

3. The method of claim 1 wherein the connector comprises two corner pins along an edge of each connector as ground pins.

4. A system for easing the attachment of a peripheral cable to a personal computer, the system comprising:

a connector with a symmetric shape that supports at least four insertion orientations of cable attachment to a personal computer; and a circuit for rearranging signal lines from the connector automatically based on an insertion orientation of the connector.

5. The system of claim 4 wherein the connector further comprises a square connector to allow at least two insertion orientations of a peripheral cable for attachment to a personal computer.

6. The system of claim 5 wherein the connector further comprises two corner ground pins.

7. The system of claim 4 wherein the circuit further comprising a multiplexer circuit.

8. The system of claim 7 wherein the multiplexer circuit comprises a circuit in the personal computer.

9. The system of claim 7 wherein the multiplexer circuit comprises a circuit in the peripheral cable.

* * * * *